US012232628B2

(12) United States Patent
Wu et al.

(10) Patent No.: US 12,232,628 B2
(45) Date of Patent: Feb. 25, 2025

(54) CHAIR ASSEMBLY

(71) Applicant: COMFORDY CO., LTD., Tainan (TW)

(72) Inventors: Yu-Ling Wu, Tainan (TW); Martin Potrykus, Bamberg (DE); Armin Roland Sander, Fürth (DE)

(73) Assignee: Comfordy Co., Ltd., Tainan (TW)

( * ) Notice: Subject to any disclaimer, the term of this patent is extended or adjusted under 35 U.S.C. 154(b) by 134 days.

(21) Appl. No.: 18/298,674

(22) Filed: Apr. 11, 2023

(65) Prior Publication Data

US 2024/0341496 A1 Oct. 17, 2024

(51) Int. Cl.

| | |
|---|---|
| ***A47C 7/54*** | (2006.01) |
| ***A47C 7/02*** | (2006.01) |
| ***A47C 7/36*** | (2006.01) |
| ***A47C 7/40*** | (2006.01) |
| ***A47C 7/42*** | (2006.01) |
| ***A47C 31/00*** | (2006.01) |

(52) U.S. Cl.

CPC ..... *A47C 31/00* (2013.01); *A47C 7/02* (2013.01); *A47C 7/36* (2013.01); *A47C 7/42* (2013.01); *A47C 7/54* (2013.01); *A47C 7/546* (2013.01)

(58) Field of Classification Search

CPC ..... A47C 7/546; A47C 4/02; A47C 7/42

See application file for complete search history.

(56) References Cited

U.S. PATENT DOCUMENTS

| | | | | |
|---|---|---|---|---|
| 5,368,364 | A * | 11/1994 | Kanai | A47C 7/546 297/411.27 |
| 5,419,617 | A * | 5/1995 | Schultz | A47C 7/546 297/411.27 X |
| 5,615,926 | A * | 4/1997 | Kanai | A47C 7/546 297/411.27 |
| 5,839,784 | A * | 11/1998 | Breen | A47C 1/0307 297/411.37 X |
| 6,409,266 | B1 * | 6/2002 | Chen | A47C 1/03 297/411.37 X |
| 7,100,977 | B2 * | 9/2006 | Burwell | A47C 7/70 297/173 |
| 9,578,971 | B2 * | 2/2017 | Su | A47C 1/03 |
| 9,795,220 | B1 * | 10/2017 | Chen | A47C 1/03 |

(Continued)

FOREIGN PATENT DOCUMENTS

DE 102015210083 A1 * 12/2016 ..... A47C 7/546

*Primary Examiner* — Rodney B White

(74) *Attorney, Agent, or Firm* — Rosenberg, Klein & Lee

(57) ABSTRACT

A chair assembly is provided. The chair assembly includes locking members arranged at a joint between a chair chassis and a seat back support and joints between the chair chassis and two armrests correspondingly. An assembly block of the locking member is formed on the chair chassis while an assembly groove of the locking member is formed in both the seat back support and the respective armrests for being fit on the assembly block of the chair chassis correspondingly. Now a tenon disposed on the assembly block is capable of being engaged with a locking hole arranged at the assembly groove. A positioning part elastically abuts against the opposite side walls of the assembly groove. Thereby assembly of the chair chassis with both the seat back support and the armrests is finished easily and quickly. The chair assembly is more comfortable and safe for users sitting thereon.

7 Claims, 6 Drawing Sheets

(56) References Cited

U.S. PATENT DOCUMENTS

| | | | | |
|---|---|---|---|---|
| 11,622,631 | B1 * | 4/2023 | Berkowitz | A47C 7/004<br>297/452.41 |
| 11,672,347 | B1 * | 6/2023 | Wu | A47C 7/42<br>297/440.15 |
| 11,950,709 | B2 * | 4/2024 | Bock | F16B 2/185 |

* cited by examiner

CHAIR ASSEMBLY

BACKGROUND OF THE INVENTION

Field of the Invention

The present invention relates to a chair, especially to a chair assembly in which a chair chassis, a seat back support, and two armrests are assembled easily and firmly.

Description of Related Art

A chair is a piece of furniture people need whether at home or in the office. Generally, the chair is composed of a seat, a back-rest, and armrests. In order to reduce cost of transportation and storage, the chair is disassembled into the seat, the back-rest, and the armrest during transportation and then assembled again after being delivered to consumers.

The seat, the back-rest, and the armrests of the chair are mainly fastened by screws. During assembly, users need to use screwdrivers for threading the screws into fastening holes at a joint between the seat and the back-rest and joints between the seat and the armrests. However, the assembly process with such design is cumbersome and time-consuming. The screws for fastening the seat, the back-rest, and the armrests come loose easily over a period of timed due to leaning against or wobbling of the chair. Thus unexpected loosening and fall-out of the screws occur and the chair is unsafe for users sitting thereon.

Thus there is room for improvement and there is a need to provide a novel chair assembly which overcomes the above shortcomings and become more convenient to use.

SUMMARY OF THE INVENTION

Therefore, it is a primary object of the present invention to provide a chair assembly having locking members which not only allows assembly of a chair chassis with both a seat back support and armrests to be finished easily and quickly, but also prevents the chair chassis, the seat back support, and the armrests from unexpected loosening and falling-off.

In order to achieve the above object, a chair assembly according to the present invention mainly includes a chair chassis, a seat back support disposed on a back side of the chair chassis, an armrest arranged at both a left side and a right side of the chair chassis, and at least one locking member which connects the chair chassis with at least one of the seat back support and the armrests.

The locking member is composed of an assembly block integrally connected with the chair chassis, at least one positioning part, and an assembly groove formed in the at least one of the seat back support and the armrests. The assembly block consists of at least one limit portion arranged concavely, at least one mounting groove mounted on the limit portion, and at least one tenon next to the limit portion. The positioning part includes two opposite springs connected at rear ends, a holding area formed between the two springs for clamping the limit portion of the assembly block, and at least one mounting protrusion disposed on an inner surface of each of the springs and capable of being mounted and connected with the mounting groove on the limit portion. The assembly groove formed in the at least one of the seat back support and the armrests is used for mounting the assembly block of the chair chassis. At least one locking hole corresponding to the assembly groove is disposed on the at least one of the seat back support and the armrests and communicated with the assembly groove for being engaged with the tenon of the assembly block. The two springs of the positioning part elastically abut against two opposite side walls of the assembly groove correspondingly.

Preferably, the assembly block is provided with the two limit portions arranged concavely, located adjacent to and spaced apart from each other, and the two positioning parts are provided and arranged at the two limit portions of the assembly block correspondingly.

Preferably, at least one tenon is arranged between the two limit portions adjacent to and spaced apart from each other.

Preferably, the assembly block and the assembly groove are tapered and correspond to each other.

Preferably, at least one raised part is disposed on an outer surface of each of the springs and the raised parts on the outer surfaces of the two springs abut against the side walls of the assembly groove for positioning.

Preferably, a stopping edge is disposed on the chair chassis where the chair chassis is connected with the assembly block, and an end portion around an opening of the assembly groove on the at least one of the seat back support and the armrests abuts against and is positioned by the stopping edge of the chair chassis.

Preferably, the chair chassis is connected with the seat back support and the armrests by the locking members correspondingly.

While being assembled, the assembly blocks of the chair chassis and the assembly grooves formed in the seat back support and the respective armrests are fit with each other correspondingly and the tenon of the assembly block is further engaged with the locking hole of the assembly groove. The positioning parts disposed on the assembly block elastically abut against the two opposite side walls of the assembly groove for positioning. Thereby not only assembly of the chair chassis with the seat back support and the armrests is finished easily and quickly, unexpected loosening or falling-off of the chair chassis, the seat back support, and the armrests can also be preventing for more comfort and safety while sitting on the chair assembly.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content, purposes and functions of the present invention more clearly and completely, please refer to the following detailed descriptions with the figures and reference signs.

Figure 1:
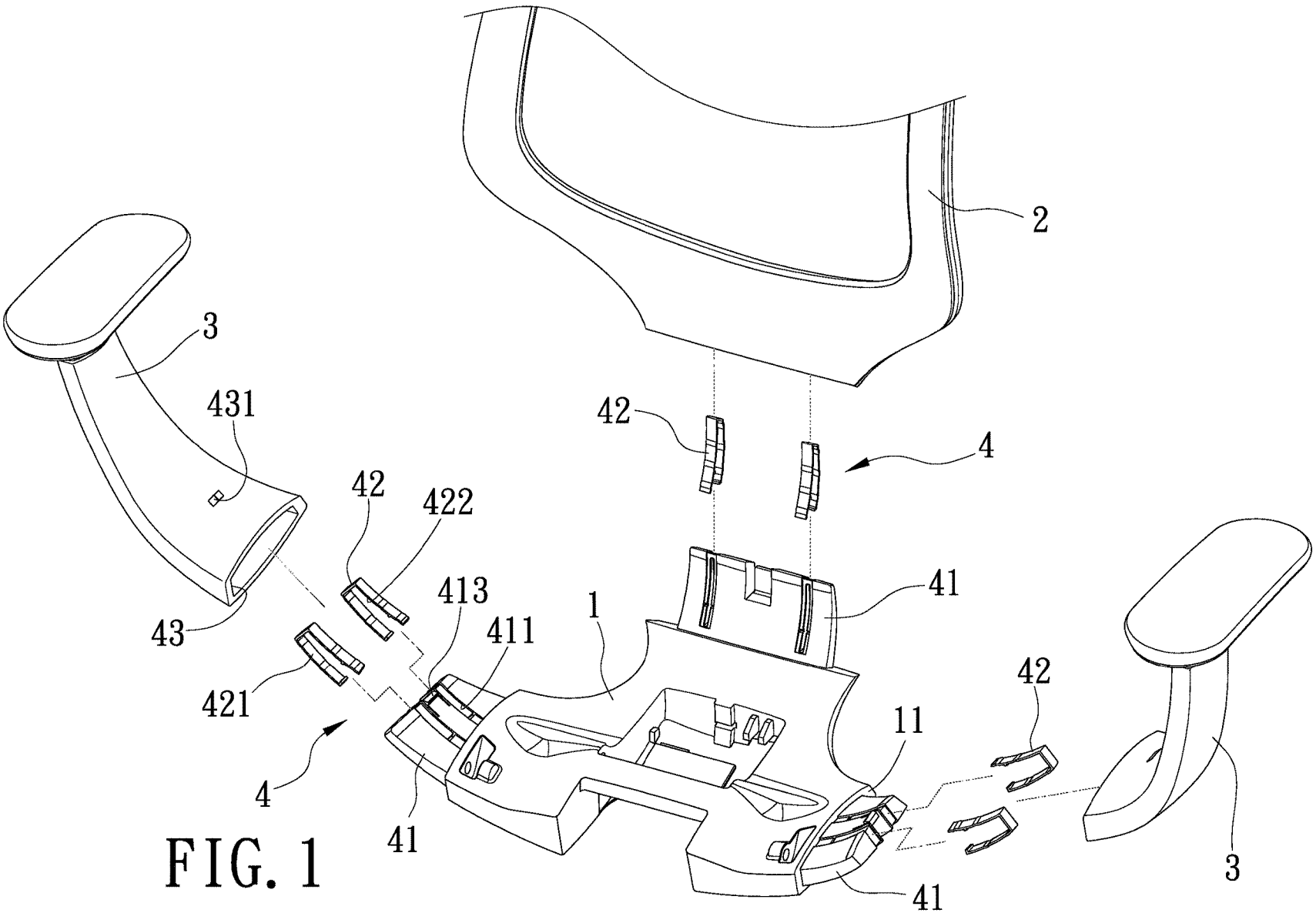
FIG. 1 is an exploded view of an embodiment according to the present invention.
Figure 2:
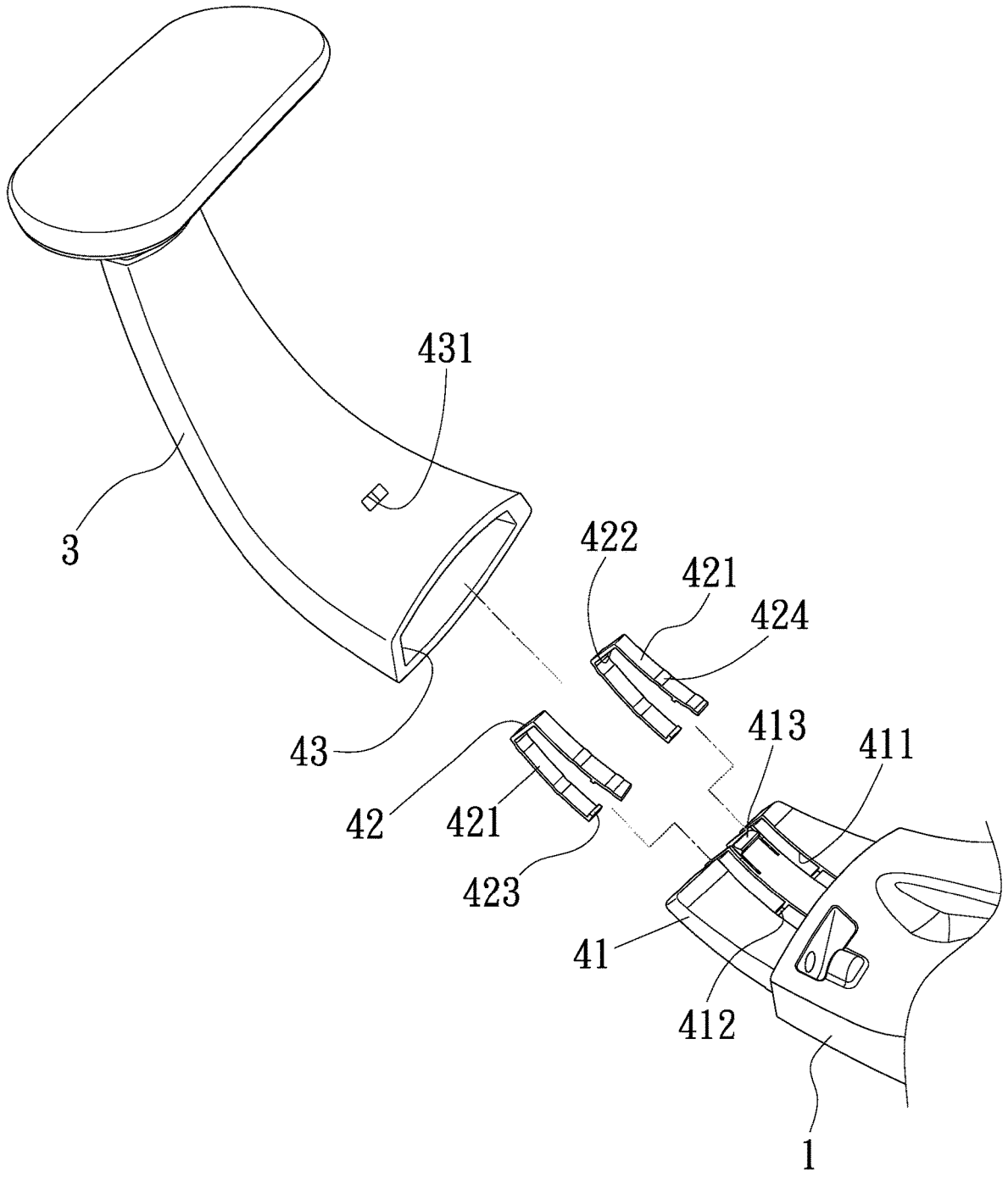
FIG. 2 is a partial exploded view of an embodiment according to the present invention.
Figure 3:
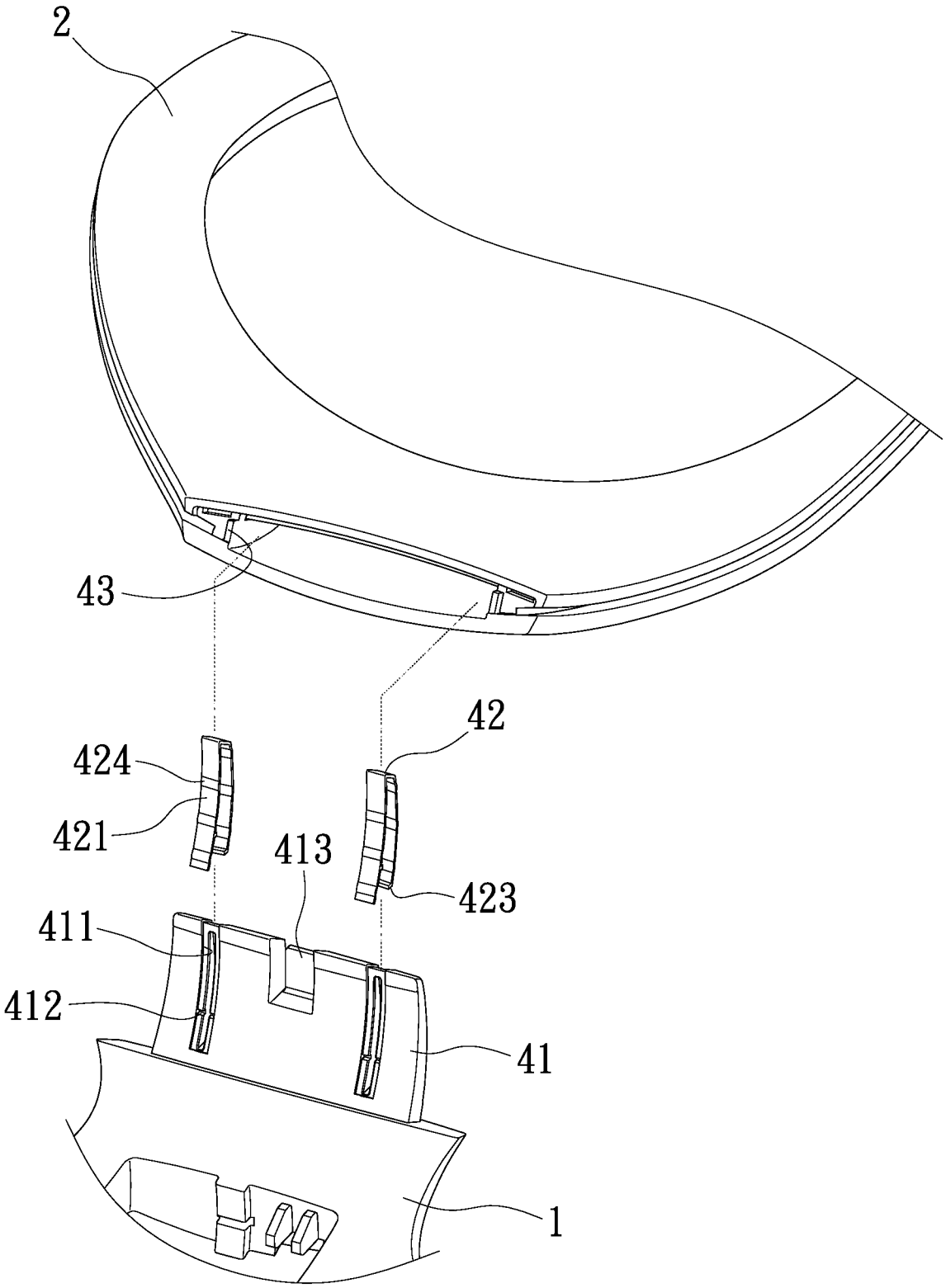
FIG. 3 is another partial exploded view of an embodiment according to the present invention.

Refer to FIG. 1-3, a chair assembly member according to the present invention mainly includes a chair chassis 1, a seat back support 2 disposed on a back side of the chair chassis 1, an armrest 3 arranged at both a left side and a right side of the chair chassis 1, and three locking members 4 arranged at a joint between the chair chassis 1 and the seat back support 2 and joints between the chair chassis 1 and the armrests 3 correspondingly.

The locking member 4 consists of an assembly block 41 integrally connected with the chair chassis 1, at least one positioning part 42, and an assembly groove 43 formed in at least one of the seat back support 2 and the respective armrests 3 at an area where the seat back support 2 and the armrests 3 are connected with the chair chassis 1. A stopping edge 11 is disposed on the chair chassis 1 where the chair chassis 1 is connected with the assembly block 41. In this embodiment, the back side, the left side and the right side of the chair chassis 1 are all provided with one assembly block 41 and integrally connected with the assembly block 41 which is tapered. The assembly block 41 is composed of two limit portions 411 arranged concavely, located adjacent to and spaced apart from each other, at least one mounting groove 412 mounted on the limit portion 411, and at least one tenon 413 located between the two limit portions 411. In this embodiment, there are two positioning parts 42 mounted to the two limit portions 411 of the assembly block 41 correspondingly. The positioning part 42 includes two springs 421 arranged opposite to each other and connected with at rear ends, a holding area 422 formed between the two springs 421 for clamping the limit portion 411 of the assembly block 41, at least one mounting protrusion 423 disposed on an inner surface of each of the springs 421 and capable of being mounted and connected with the mounting groove 412 on the limit portion 411, and at least one raised part 424 disposed on an outer surface of each of the springs 421. The assembly grooves 43 which are tapered and formed in the seat back support 2 and the armrests 3 are used for mounting the assembly blocks 41 on the back side, the left side and the right side of the chair chassis 1 correspondingly. An end portion around an opening of the assembly groove 43 on both the seat back support 2 and the armrest 3 abuts against and is positioned by the stopping edge 11 located at where the chair chassis 1 is connected with the assembly block 41. At least one locking hole 431 corresponding to the assembly groove 43 is disposed on the seat back support 2 and the armrest 3 and communicated with the assembly groove 43 for being engaged with the tenon 413 of the assembly block 41. The two springs 421 of the positioning part 42 elastically abut against two opposite side walls of the assembly groove 43 correspondingly and the raised parts 424 on the outer surfaces of two the springs 421 of the positioning part 42 abut against the side walls of the assembly groove 43 for positioning.

Figure 4:
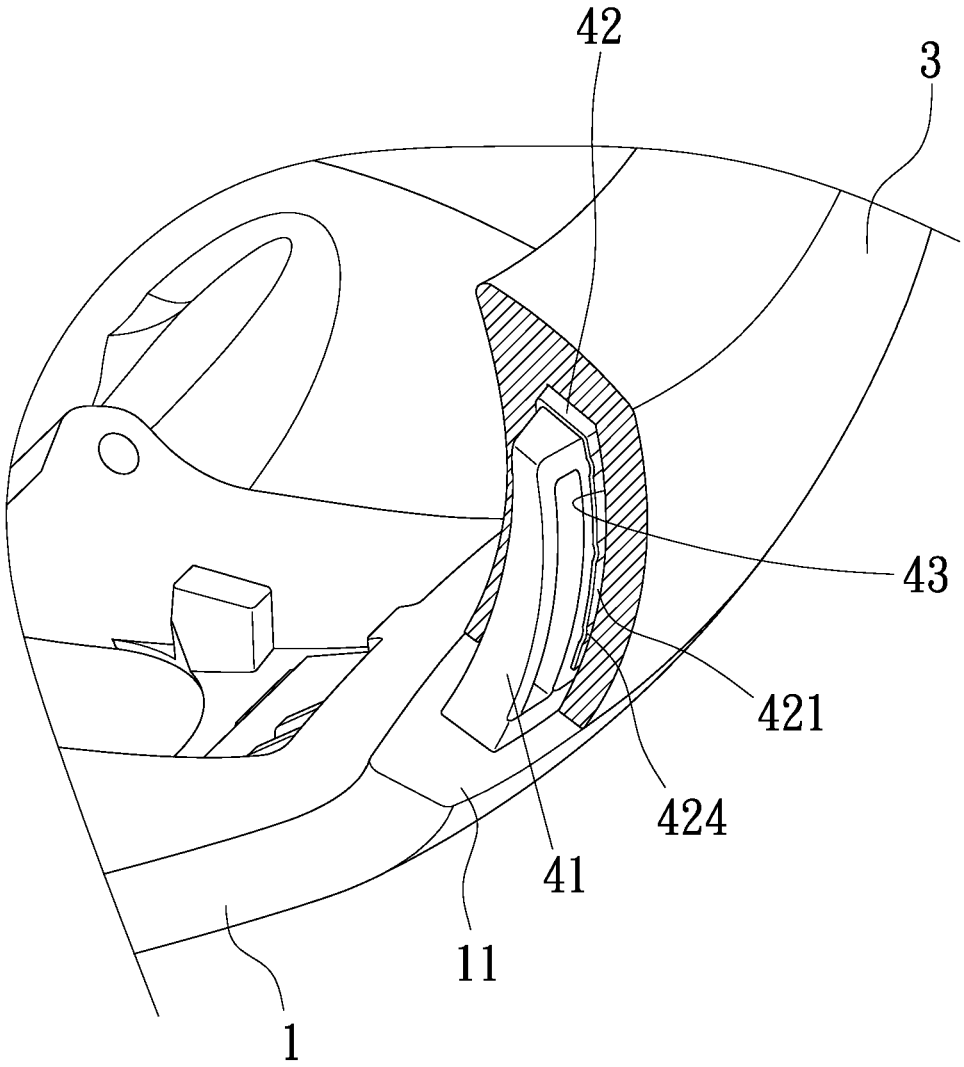
FIG. 4 is a partial perspective sectional view of an embodiment according to the present invention.
Figure 5:
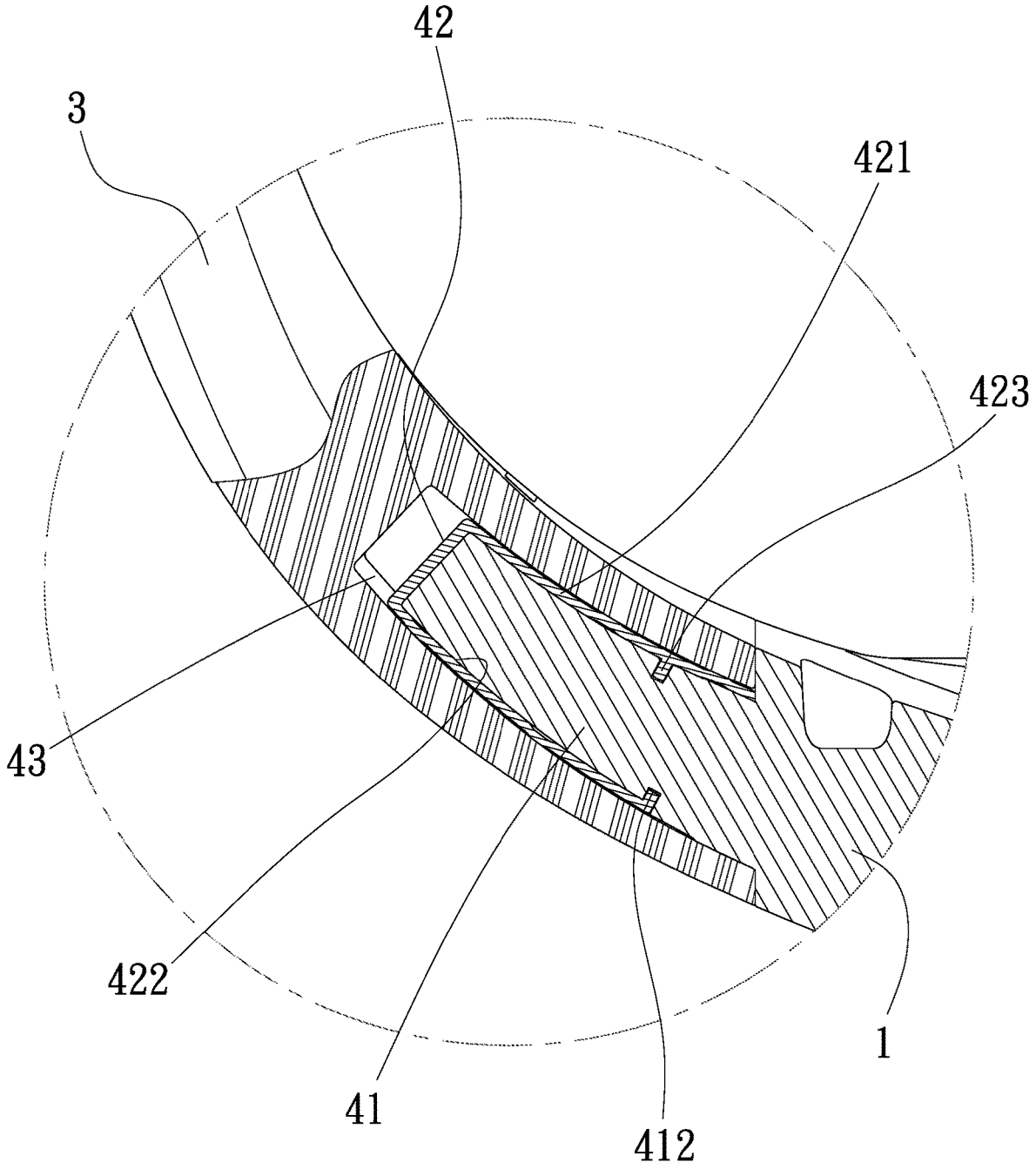
FIG. 5 is a partial sectional view of an embodiment according to the present invention.
Figure 6:
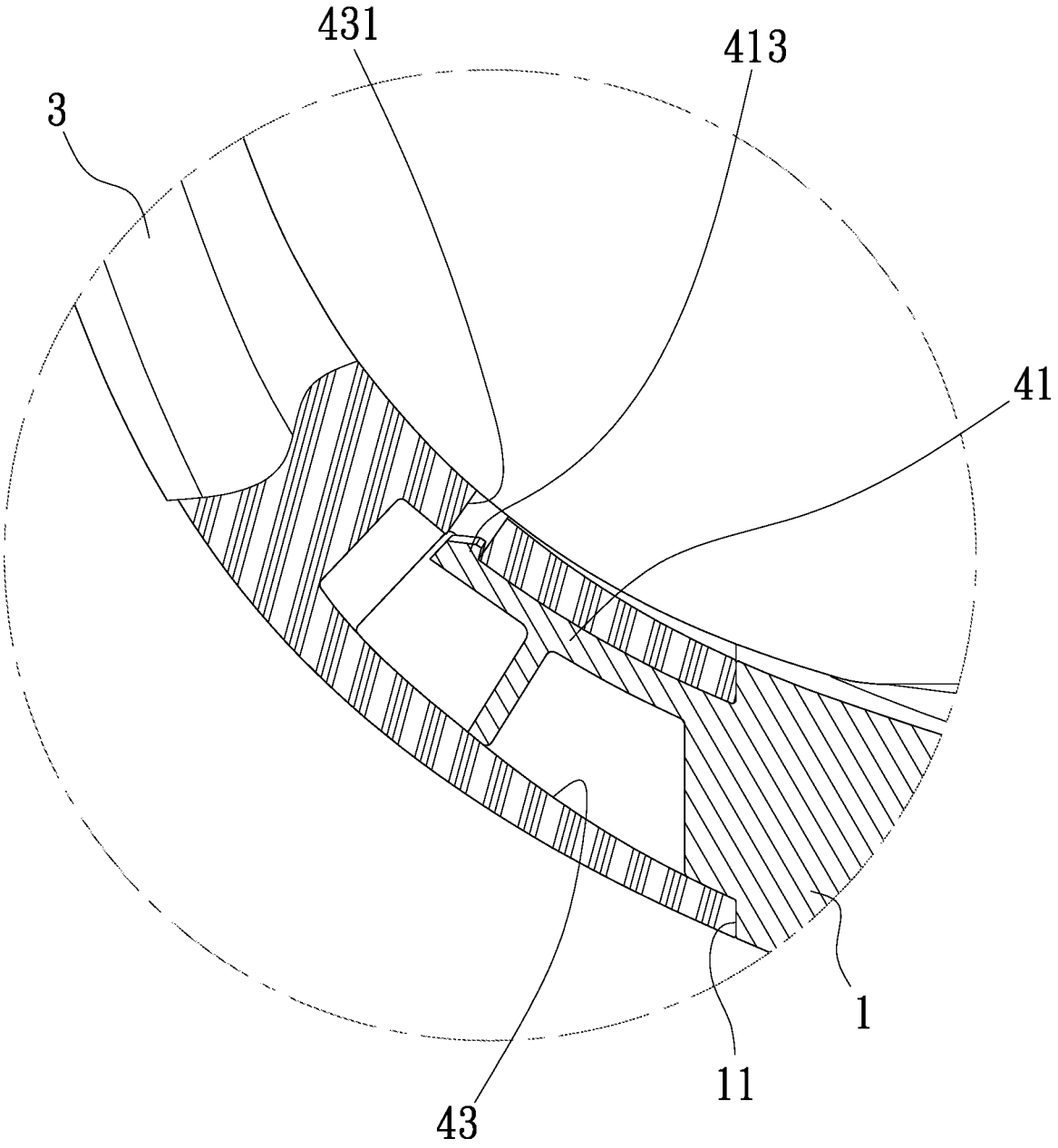
FIG. 6 is another partial sectional view of an embodiment according to the present invention.

While being assembled, as shown in FIG. 4 and FIG. 5, the limit portion 411 of the assembly block 41 connected with the chair chassis 1 is clamped by the holding area 422 of the positioning part 42. Now the mounting protrusion 423 on the inner surface of the two springs 421 of the positioning part 42 are mounted and connected with the mounting groove 412 on the limit portion 411 of the assembly block 41 to fix the positioning part 42 on the assembly block 41. Then the assembly grooves 43 on both the seat back support 2 and the respective armrests 3 are fit onto the assembly blocks 41 formed on the chair chassis 1. After the end portion of the seat back support 2 and the respective armrests 3 being positioned by the stopping edge 11 located between the chair chassis 1 and the assembly block 41, positioning accuracy and tightness of the assembly block 41 and the assembly groove 43 assembled with each other are improved by tapers of the assembly block 41 and the assembly groove 43. Also refer to FIG. 6, the tenon 413 of the assembly block 41 is just engaged with the locking hole 431 of the assembly groove 43 and the two springs 421 of the positioning part 42 elastically abut against the two opposite side walls of the assembly groove 43 correspondingly.

Compared with the chair assembly available now formed by the seat, the back-rest, and the armrests fastened with screws, assembly of the chair chassis 1, the seat back support 2, and the armrests 3 can be finished easily and quickly by locking design of the present chair assembly. After being used for a period of time, the screws may get loose or fall out unexpectedly so that the seat back support 2 and the armrests 3 become wobbly or fall off. Thereby the locking design of the present chair assembly makes users more comfortable and safe while sitting on the present chair assembly.

The number of the locking member 4 is not limited. There is at least one locking member 4 used to connect the chair chassis 1 with the seat back support 2 or the armrest 3.

In summary, the present chair assembly has the following advantages.

1. By the locking members, assembly of the chair chassis with both the seat back support and the armrests is finished easily and quickly. Thus both assembly time and labor cost are saved effectively.

2. The chair chassis is connected with both the seat back support and the armrests by the locking members in the chair assembly. Thus situations caused by loose screws such as wobbling or falling of the seat back support and the armrests can be avoided. The chair assembly is more comfortable and safe when users sit thereon.

3. Since the chair chassis is connected with both the seat back support and the armrests by the locking members in the chair assembly, they can be disassembled and then stacked respectively during transportation and storage. Thereby cost of transportation and storage is reduced because that less space is occupied.

4. The chair chassis can be connected and disconnected with both the seat back support and the armrests by the locking members in the chair assembly. Thus not only the seat back support and the armrests can be replaced conveniently, repair, maintenance, and cleaning are also quite easy.

5. Both the assembly block and the assembly groove are tapered. Thereby after the assembly block and the assembly groove being fit to each other, positioning accuracy and tightness of the assembly block and the assembly groove assembled are increased by corresponding tapers of the assembly block and the assembly groove.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A chair assembly comprising a chair chassis, a seat back support disposed on a back side of the chair chassis, and two armrests arranged at a left side and a right side of the chair chassis correspondingly, and at least one locking member which connects the chair chassis with at least one of the seat back support and the armrests;

wherein the locking member includes an assembly block integrally connected with the chair chassis, at least one positioning part, and an assembly groove formed in the at least one of the seat back support and the armrests; wherein the assembly block consists of at least one limit portion arranged concavely, at least one mounting groove mounted on the limit portion, and at least one tenon next to the limit portion; wherein the positioning part includes two opposite springs connected at rear ends, a holding area formed between the two springs for clamping the limit portion of the assembly block, and at least one mounting protrusion disposed on an inner surface of each of the springs and capable of being mounted and connected with the mounting groove on the limit portion; wherein the assembly groove formed in the at least one of the seat back support and the armrests and the assembly block of the chair chassis are fit with each other; wherein at least one locking hole corresponding to the assembly groove is disposed on the at least one of the seat back support and the armrests and communicated with the assembly groove for being engaged with the tenon of the assembly block, and the two springs of the positioning part elastically abut against two opposite side walls of the assembly groove correspondingly.

2. The chair assembly as claimed in claim 1, wherein the assembly block is provided with the two limit portions adjacent to and spaced apart from each other, and the two positioning parts are provided and arranged at the two limit portions of the assembly block correspondingly.

3. The chair assembly as claimed in claim 2, wherein the tenon is arranged between the two limit portions adjacent to and spaced apart from each other.

4. The chair assembly as claimed in claim 1, wherein the assembly block and the assembly groove are tapered and correspond to each other.

5. The chair assembly as claimed in claim 1, wherein at least one raised part is disposed on an outer surface of each of the springs and the raised parts on the outer surfaces of the two springs abut against the side walls of the assembly groove for positioning.

6. The chair assembly as claimed in claim 1, wherein a stopping edge is disposed on the chair chassis where the chair chassis is connected with the assembly block, and an end portion around an opening of the assembly groove on the at least one of the seat back support and the armrests abuts against and is positioned by the stopping edge of the chair chassis.

7. The chair assembly as claimed in claim 1, wherein the chair chassis is connected with the seat back support and the armrests by the locking members correspondingly.

* * * * *